US005971008A

United States Patent [19]

de Bertier

[11] Patent Number: 5,971,008

[45] Date of Patent: Oct. 26, 1999

[54] DEVICE POSITIONABLE UPSTREAM FROM A SHOWER NOZZLE FOR DISPENSING SOLID, WATER-SOLUBLE OR WATER-DISPERSIBLE MATERIALS

[75] Inventor: Alexis de Bertier, Paris, France

[73] Assignee: Laboratoire D'Hygiene Dermique S.A.R.L., Rocquemont, France

[21] Appl. No.: 09/011,665

[22] PCT Filed: Jun. 13, 1997

[86] PCT No.: PCT/FR97/01060

§ 371 Date: Apr. 22, 1998

§ 102(e) Date: Apr. 22, 1998

[87] PCT Pub. No.: WO97/47827

PCT Pub. Date: Dec. 18, 1997

[30] Foreign Application Priority Data

Jun. 14, 1996 [FR] France ..... 96/07396

[51] Int. Cl.[6] ..... E03C 1/046

[52] U.S. Cl. ..... 137/268; 239/310; 422/266

[58] Field of Search ..... 137/268, 205.5, 137/564.5; 239/310; 422/266, 261

[56] References Cited

U.S. PATENT DOCUMENTS 3,003,518 10/1961 Tisdale ..... 137/268

3,759,284 9/1973 Crowley et al. ..... 137/268

4,294,280 10/1981 Tom ..... 137/268

FOREIGN PATENT DOCUMENTS 2264583 10/1975 France .

375390 5/1923 Germany .

1955111 5/1971 Germany .

*Primary Examiner*—Kevin Lee

*Attorney, Agent, or Firm*—Jacobson, Price, Holman & Stern, PLLC

[57] ABSTRACT

A device positionable upstream from a shower nozzle for dispensing solid, water-soluble or water-dispersible materials is disclosed. The device includes a tubular body (1) of which a first end (2) has a circular flange (3) and comprises an internal thread (4) defining a first shoulder (5), and a second end is threaded; and a cylindrical coupling portion (6) comprising a circular abutment (7) and two threads on either side thereof, i.e., a first or outer thread (8) with a diameter suitable for engagement with a shower hose, and a second or internal thread (9) with a diameter suitable for screwing said portion (6) into the second end of the body (1). The end of said internal thread forms a second shoulder (10). A chamber (11) is defined inside said body (1) between the first (5) and second (10) shoulders, whereat the wall of said body (1) comprises a window (12) for inserting a solid material into said chamber (4). A sealing ring (14) is positioned around said body (1) and slidable between the circular flange (3) and the circular abutment (7).

3 Claims, 1 Drawing Sheet

DEVICE POSITIONABLE UPSTREAM FROM A SHOWER NOZZLE FOR DISPENSING SOLID, WATER-SOLUBLE OR WATER-DISPERSIBLE MATERIALS

BACKGROUND OF THE INVENTION

The present invention relates to a device positionable upstream from a shower nozzle for dispensing solid, water-soluble or water-dispersible materials.

Shower users have wished to find again or to find in the shower the possibility of receiving water charged with a foaming or perfumed or washing product: just as the person in his bath can add foaming or perfumed or washing products to the water.

Until the present, shower users have had two possibilities: either using devices only distributing such products solely in liquid form, or covering themselves with such products before any washing or rinsing.

SUMMARY OF THE INVENTION

Also, one of the aims of the present invention is to provide a distributor device for solid foaming or perfumed or washing products, which is situated upstream of a shower nozzle.

Another aim of the present invention is to provide such a device which does not necessitate any adaptation of the existing shower apparatus.

These aims, and also others which will become apparent hereinbelow, are addressed by a device positionable upstream from a shower nozzle for dispensing solid, water-soluble or water-dispersible products, which is characterised according to the present invention in that it comprises, firstly, a tubular body, one end or first end of which is provided with a circular flange and comprises an internal thread defining a first shoulder, and the other end of which, or second end, is likewise threaded, secondly, a cylindrical connecting piece comprising a circular abutment and two threads on either side thereof, a first thread or external thread, the diameter of which permits cooperation with the hose of a shower, and a second thread or internal thread, the diameter of which permits the screwing of this piece in the second end of the body, the end of this internal thread constituting a second shoulder, and in that inside this body and between the first and the second shoulder a chamber is defined, the wall of the body comprising at this level a window for the introduction of a solid product in this chamber, a sealing ring being situated around said body and being able to slide between the circular flange and the circular abutment.

Advantageously this distributor device comprises a first circular joint between the tubular body and the internal thread; a second circular joint is arranged between the window and the circular flange, a third circular joint being arranged in the sealing ring.

Advantageously, the connecting piece comprises a grid at the level of the second shoulder.

BRIEF DESCRIPTION OF THE DRAWINGS

The following description, which does not comprise any restrictive character, must be read with regard to the attached figures, in which.

DESCRIPTION OF THE PREFERRED EMBODIMENT

Figure 1:
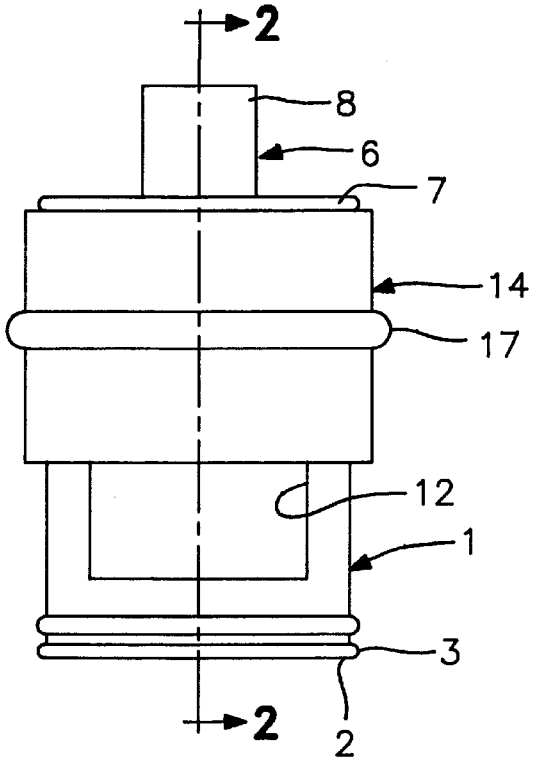
FIG. 1 is a front view of a distributor device according to the present invention.
Figure 2:
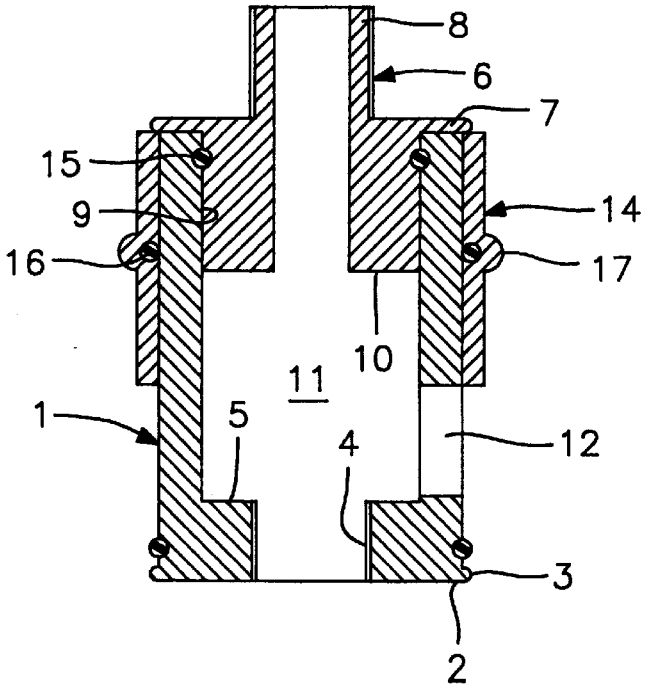
FIG. 2 is a longitudinal section of the object of FIG. 1 according to the line II—II.

As can be seen in the figures, a distributor device for a solid product comprises a tubular body 1, one end 2 or first end of which is provided with a circular flange 3 and comprises an internal thread 4 defining a first shoulder 5 inside this tubular body 1. By this thread, the distributor device according to the invention can be fixed to the outlet of a tap or to the rear of a shower nozzle.

This distributor device also comprises a cylindrical connecting piece 6 which comprises a circular abutment 7 on either side of which there are situated two threads: a first thread 8, or external thread, allowing the distributor device to be screwed to the hose of a shower, and a second thread 9, or external thread, allowing the screwing of the connecting piece 6 in the second end of the tubular body 1. The free end of this second thread 9 constitutes a second shoulder 10. Inside the tubular body 1, a chamber 11 is therefore defined by the internal wall thereof and the first 5 and second 10 shoulders. The tubular body 1 is provided at the level of this chamber 11, especially at the level of the first shoulder 5, with a window 12 permitting the introduction of a water-soluble or water-dispersible solid product inside this chamber 11.

In addition, the distributor device according to the present invention comprises a sealing ring 14 sliding on the tubular body 1 between the circular flange 3 and the circular abutment 7.

To realise the tightness of this distributor device, the latter comprises, in this example embodiment, three circular joints:

- a first 15 between the internal thread 9 and the corresponding wall of the tubular body 1;
- a second 16 between the sealing ring 14 and the corresponding wall of the tubular body 1. This second circular joint 16 is situated in a circular housing 17 arranged in the sealing ring and forming a flange outside this ring: this flange advantageously constitutes a means of support for handling this ring 14.
- a third 18 arranged on the tubular body 1 between the circular flange 3 and the window 12: it cooperates with the sealing ring 14 when the latter covers the window 12.

To introduce a solid, water-soluble or water-dispersible product comprising especially a foaming or perfuming or washing product into the tubular body 1, the sealing ring 14 is pushed back against the circular abutment 7 so as to uncover the window 12 through which the solid product is introduced. The latter then rests on the first shoulder 5. Then, the window 12 is covered by causing the sealing ring 14 to slide on the tubular body 1 in the direction of the circular flange 3. when the ring is in abutment against the latter, it covers the window 12 again and also the third circular joint 18. In this position, the tightness of the window is ensured by the second 16 and third 18 circular joints which are situated on either side of this window 12.

The connecting piece 6 can comprise at the level of the second shoulder 10 a grid 19 to break up the jet and create a turbulence in the chamber 11. This turbulence especially allows the solid product present in this chamber to dissolve better.

The solid, water-soluble or water-dispersible product can also comprise, in association or not, a disinfectant, a bactericide agent or a therapeutic composition, for example.

According to a modified embodiment of the present invention, the tubular body can comprise in its wall a water passage allowing the chamber to be short-circuited. The distributor device is thus provided with a means for directing the water either towards the chamber or towards this passage.

I claim:

1. A device positionable upstream from a shower nozzle for distributing solid, water-soluble or water-dispersible products, said device comprising a tubular body (1) a first end (2) of which is provided with a circular flange (3) and comprises an internal thread (4) defining a first shoulder (5), and a second end of which is likewise threaded, a cylindrical connecting piece (6) comprising a circular abutment (7) and two threads on either side thereof, an external thread (8), the diameter of which permits cooperation with the hose of a shower, and an internal thread (9) the diameter of which permits the screwing of said piece (6) in the second end of the body (1), the end of this internal thread constituting a second shoulder (10), and in that inside said body (1) and between the first (5) and the second shoulder (10) a chamber (11) is defined, a wall of said body (1) comprising at this level a window (12) for the introduction of a solid product into said chamber (4), a sealing ring (14) being situated around said body (1) and being able to slide between the circular flange (3) and the circular abutment (7).

2. A device according to claim 1, wherein said device comprises a first circular joint (15) between the body (1) and the internal thread (9); a second circular joint (18) arranged between the window (12) and the circular flange (3), a third circular joint (16) being arranged in the sealing ring (14).

3. A device according to claim 1, wherein the connecting piece (6) comprises a grid (19) at the level of the second shoulder (10).

* * * * *